US009464618B2

(12) United States Patent
Stifel et al.

(10) Patent No.: US 9,464,618 B2
(45) Date of Patent: Oct. 11, 2016

(54) CORONA IGNITION DEVICE AND METHOD FOR PRODUCING AN IGNITION HEAD FOR A CORONA IGNITION DEVICE

(71) Applicant: BorgWarner BERU Systems GmbH, Ludwigsburg (DE)

(72) Inventors: Timo Stifel, Korntal-Münchingen (DE); Helmut Müller, Hessigheim (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 201 days.

(21) Appl. No.: 14/060,199

(22) Filed: Oct. 22, 2013

(65) Prior Publication Data

US 2014/0116370 A1 May 1, 2014

(30) Foreign Application Priority Data

Oct. 30, 2012 (DE) ..... 10 2012 110 362

(51) Int. Cl.
*H01T 13/20* (2006.01)
*F02P 23/04* (2006.01)
*H01T 13/50* (2006.01)

(52) U.S. Cl.
CPC ..... *F02P 23/04* (2013.01); *H01T 13/20* (2013.01); *H01T 13/50* (2013.01); *Y10T 29/49002* (2015.01)

(58) Field of Classification Search
CPC ..... F02P 13/00; F02P 3/01; F02P 15/00; H01T 13/02; H01T 13/20; H01T 19/04; H01T 13/32
USPC ... 123/143 B, 169 EL, 169 MG, 169 R, 536, 123/606, 608; 313/136–142; 29/592.1
See application file for complete search history.

(56) References Cited

U.S. PATENT DOCUMENTS 8,217,560 B2 * 7/2012 Giffels ..... H01T 13/20 313/136
8,857,396 B2 * 10/2014 Giffels et al. ..... 123/169 R
2002/0037804 A1 * 3/2002 Sugimoto ..... C03C 3/066 501/139
2003/0218081 A1 * 11/2003 Kato ..... F02M 51/0667 239/585.1
2005/0127809 A1 * 6/2005 Lindsay ..... H01T 13/39 313/141

(Continued)

FOREIGN PATENT DOCUMENTS

DE 10 2010 045 173 A1 3/2012
DE 10 2010 045 175 A1 3/2012

(Continued)

*Primary Examiner* — Hung Q Nguyen
*Assistant Examiner* — Xiao Mo
(74) *Attorney, Agent, or Firm* — Bose McKinney & Evans LLP

(57) ABSTRACT

The invention relates to corona ignition device for igniting fuel in a combustion chamber of an engine by means of a corona discharge, comprising an insulator, a center electrode, which plugs into the insulator and carries an ignition head having a plurality of ignition needles, and a housing, into which the insulator plugs. In accordance with the invention, the ignition needles and the center electrode plug into the ignition head. The invention also relates to a method for producing an ignition head for a corona ignition device, wherein a green compact of the ignition head is produced by injection molding of metal powder, and the green compact is sintered while ignition needles and/or a center electrode plug thereinto.

11 Claims, 3 Drawing Sheets

(56) References Cited

U.S. PATENT DOCUMENTS

2008/0074004 A1* 3/2008 Yamamoto ..... C04B 35/493 310/358
2010/0212631 A1* 8/2010 Makarov ..... F02P 23/045 123/406.19
2010/0282197 A1 11/2010 Permuy et al.
2011/0215703 A1 9/2011 Maul et al.
2012/0055434 A1* 3/2012 Giffels ..... H01T 13/50 123/169 R
2014/0116369 A1* 5/2014 Stifel ..... F02P 23/04 123/143 B

FOREIGN PATENT DOCUMENTS

WO WO 2009 016 310 A2 2/2009
WO WO 2011/130365 A1 10/2011

* cited by examiner

CORONA IGNITION DEVICE AND METHOD FOR PRODUCING AN IGNITION HEAD FOR A CORONA IGNITION DEVICE

RELATED APPLICATIONS

This application claims priority from DE 10 2012 110 362.3, filed Oct. 30, 2012, which is hereby incorporated herein by reference in its entirety.

BACKGROUND

The invention relates to a corona ignition device for igniting fuel in a combustion chamber of an engine by means of a corona discharge. Such corona ignition devices are generally known from DE 10 2010 045 173 A1.

Fuel can be ignited more easily in a combustion chamber of an engine by a corona discharge, the greater is the volume of the corona discharge. Center electrodes of corona ignition devices therefore generally carry an ignition head having a plurality of ignition tips, from each of which a corona discharge can start.

Ignition heads having a plurality of ignition tips can be produced very cost effectively by cutting out from sheet metal, as is described in DE 10 2010 045 175 A1. However, only few spatial directions can be covered by the ignition tips of a star-shaped ignition head cut out from sheet metal, and therefore the attainable volume of the corona discharges starting from the ignition tips is limited.

With ignition heads that have a plurality of ignition needles, a corona discharge can be generated in a much greater volume since the ignition needles can protrude in any directions from the ignition head. The production of ignition heads of this type is associated with much higher costs, however.

SUMMARY

The present invention specifies a way in which an ignition head that has a plurality of ignition needles, or a corona ignition device comprising such an ignition head, can be produced cost effectively.

In accordance with this disclosure, cost-effective manufacture is achieved by producing the ignition needles as separate components, which plug into the ignition head similarly to the center electrode. A one-piece production of the ignition head including ignition needles is possible, but is more complex.

The ignition head is produced in accordance with this disclosure by powder injection molding from metal, for example from steel or a nickel base alloy. Production by casting of a melt, for example gravity die casting or centrifugal casting, is indeed likewise possible, but requires greater effort to observe narrow manufacturing tolerances and also requires finishing. A key advantage of production by powder injection molding is in particular also that the needles, when sintering a green compact produced by powder injection molding, can be stuck in the green compact with their end remote from the ignition tip and can then be integrally bonded to the ignition head as a result of the sintering process. It is possible to stick the needles into the green compact after the powder injection molding process. It is also possible however that the needles are overmolded when producing the green compact. In addition to the connection of the needles to the ignition head by means of the sintering process, the needles can be welded to the ignition head, for example by laser welding or resistance welding.

Instead of having the ignition needles stuck in the green compact, it is also possible to plug the ignition needles, after the sintering process, into depressions or bores and to also fix them there by welding.

In accordance with an advantageous refinement of this disclosure, the ignition needles or the ignition tips of the ignition needles consist of a more wear-resistant metal. For example, the ignition needles may have ignition tips made of platinum metal or an alloy based on platinum metal. In the simplest case, the ignition needles can consist completely of platinum metal. It is also possible however for an ignition tip made of platinum metal to be welded onto a pin-shaped main body.

Platinum metals are sometimes also referred to as platinoids. A platinum metal is a metal in the platinum group, that is to say Ru, Rh, Pd, Os, Ir and Pt. Platinum metals and platinum metal base alloys, that is to say alloys that consist predominantly, preferably more than 80% by weight and particularly preferably more than 90% by weight, of platinum metal, are suitable as material for ignition tips.

In accordance with a further advantageous refinement of this disclosure, the ignition tips have an ignition edge running at an incline relative to the longitudinal direction of the ignition needles. An ignition edge, similarly to a conical tip, also leads to a local increase of the electric field strength and thus facilitates the formation of a corona discharge. Blunting by burn-up is a problem with conical ignition tips and may lead to premature failure if an electric field of sufficient strength is no longer formed at a rounded tip. In the case of an ignition edge, only a small portion of the ignition edge at which the greatest electric field strength occurs and from which a corona discharge starts is ever blunted by burn-up. If this small portion is blunted, the increase in the electric field is practically unchanged at an adjoining portion of the ignition edge, from which the corona discharge then starts. Many more operating hours than with an ignition needle having a conical tip pass until an ignition edge is blunted over its entire length and the ignition needle is thus made unusable.

An ignition edge can be produced with little effort by grinding or cutting an ignition needle along a plane running transverse to its longitudinal direction. Here, the ignition needle can be ground or cut perpendicular to its longitudinal direction or at an incline relative to its longitudinal direction.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
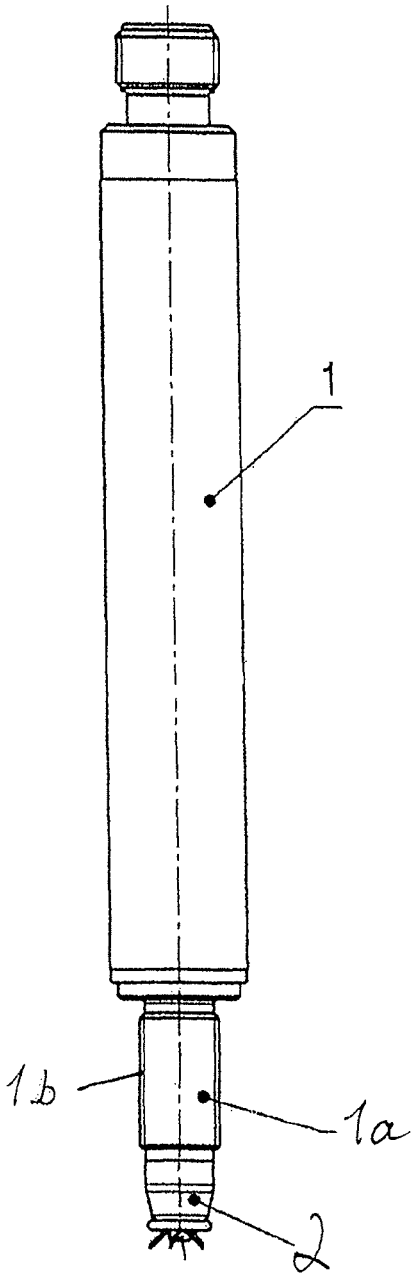
FIG. 1 shows an illustrative embodiment of a corona ignition device.
Figure 2:
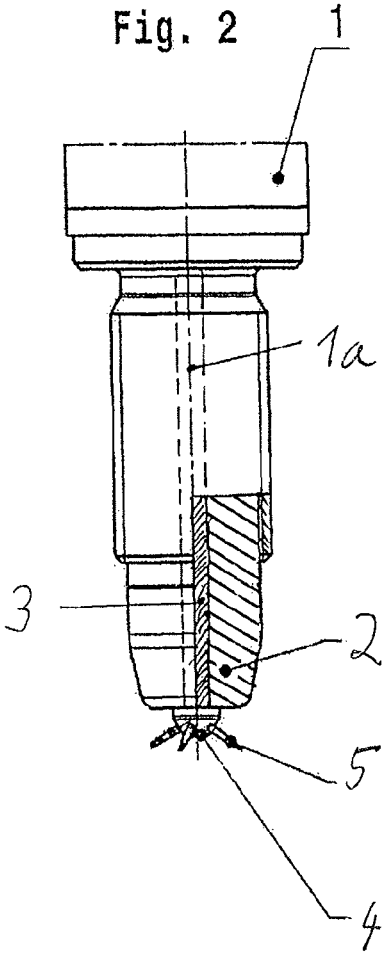
FIG. 2 shows a partly sectional detail of FIG. 1.

The ignition device illustrated in FIGS. 1 and 2 generates a corona discharge for igniting fuels in a combustion chamber of an engine. The corona ignition device has a housing 1, which is closed at one end by an insulator 2. A center electrode 3, which carries an ignition head 4 having a plurality of ignition needles 5, plugs into the insulator 2. The center electrode 3, together with the insulator 2 and the housing 1, forms a capacitor, which is connected in series to a coil connected to the center electrode 3. This capacitor and the coil arranged in the housing are part of an electric oscillating circuit, the excitation of which makes it possible for corona discharges to be produced at the ignition tips of the ignition head 4.

An end portion 1*a* of the housing 1 surrounding the insulator 2 may have an outer thread 1*b* for screwing into an engine block. Instead of an outer thread, the corona ignition device may also be fastened to an engine block using other means however.

Figure 3:
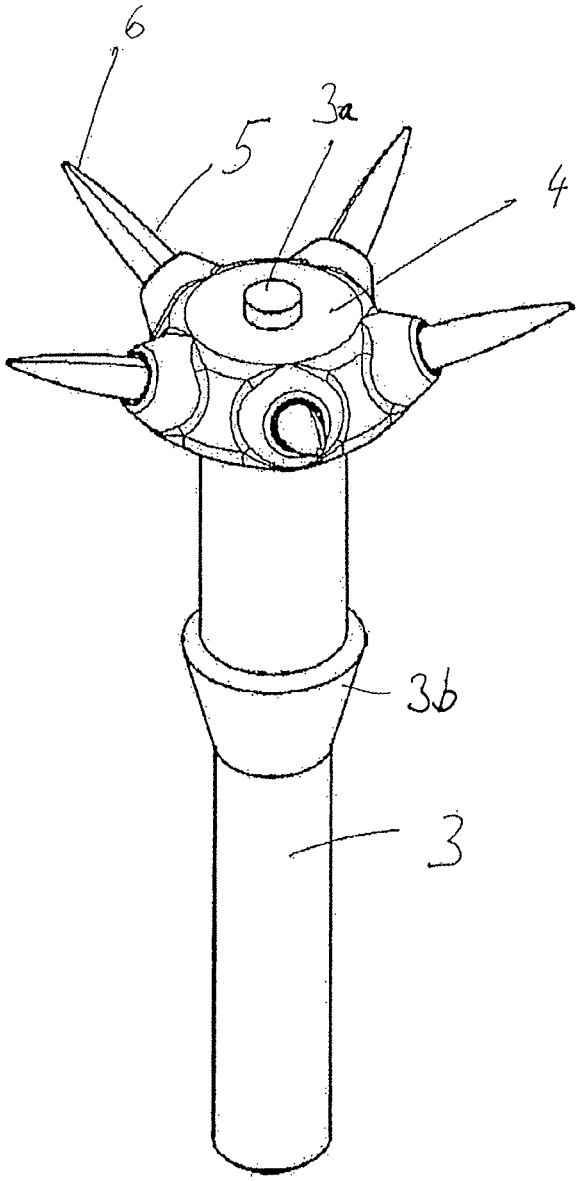
FIG. 3 shows a schematic illustration of an illustrative embodiment of an ignition head of a corona ignition device comprising ignition needles and part of the center electrode.

FIG. 3 shows an illustrative embodiment of an ignition head 4 comprising ignition needles 5 and a portion of the center electrode 3. The ignition head 4 is produced from metal, for example steel or a nickel base alloy, by powder injection molding. Here, a green compact is initially produced. The green compact is then sintered, and in doing so any binder contained in the green compact is removed. During the sintering process, the ignition needles 5 are stuck in the green compact with their ends remote from their ignition tip 6. Due to the sintering, an integral bond is produced between the finished ignition head 4 and the ignition needles 5. In addition, the ignition needles 5 may later also still be welded to the ignition head 4.

The ignition needles 5 can be placed in an injection mold and then overmolded when the green compact is powder injection molded. Alternatively, it is also possible however to plug the ignition needles 5 into the green compact. In any case, the ignition needles 5 are stuck with their end remote from their ignition tip 6 in the finished ignition head 4. A portion of the center electrode 3 is also stuck in the ignition head 4. This portion can protrude through the ignition head 4 or can end in the ignition head 4. In the illustrative embodiment shown in FIG. 3, one end 3*a* of the center electrode protrudes from the ignition head 4 on the side remote from the insulator 2. A portion of the center electrode 3 can be placed in an injection mold and then overmolded when the green compact is powder injection molded. Alternatively, it is also possible to stick the center electrode 3 into the finished green compact or, after sintering, into the ignition head 4. The center electrode 3 can also be welded or riveted to the ignition head, for example.

The portion of the center electrode 3 fastened to the ignition head 4 may have a conical sealing face 3*b* in order to facilitate a gas-tight closure of the bore leading through the insulator 2.

Figure 4:
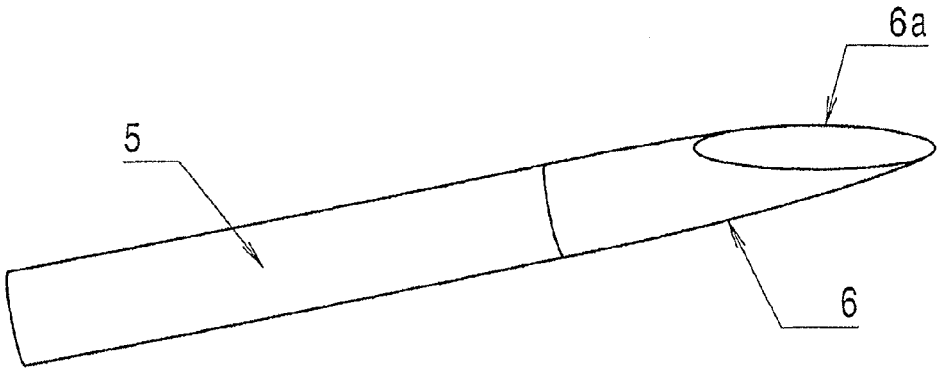
FIG. 4 shows an ignition needle.

An illustrative embodiment of an ignition needle 5 is illustrated in FIG. 4. The ignition needle 5 has a cylindrical body, which is ground at an incline relative to its longitudinal direction. By grinding or cutting along a plane running transverse to the longitudinal direction of the ignition needle 5, ignition tips 6 are formed. By inclined cutting or grinding, a burr running lengthwise that forms an ignition edge is produced. Blunt cutting or grinding is also possible, whereby a blade-shaped burr can be produced which forms a peripheral ignition edge.

It is advantageous in the illustrative embodiment shown in FIG. 4 that the ignition tips 6, that is to say the end portion of the ignition needles 5, from which a corona discharge starts, have an ignition edge 6*a*. This ignition edge 6*a* can have an elliptical course. The ignition needle 5 may consist for example of steel, a nickel base alloy, platinum metal, or a platinum metal base alloy.

Figure 5:
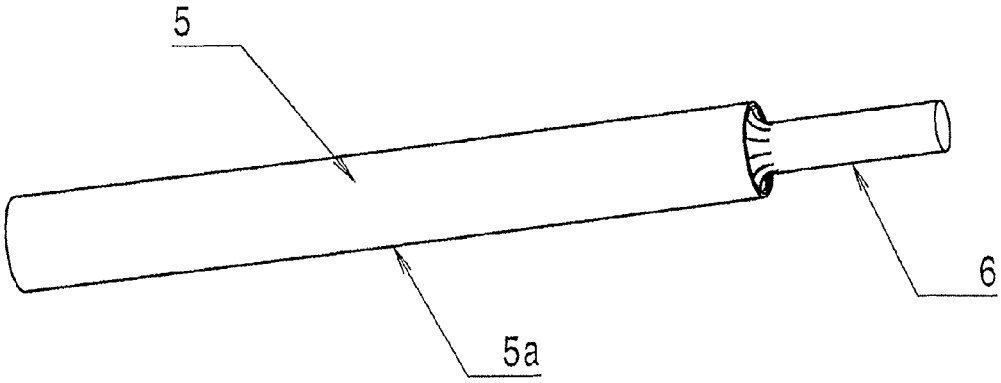
FIG. 5 shows a further illustrative embodiment of an ignition needle.

FIG. 5 shows a further illustrative embodiment of an ignition needle 5, which comprises a pin-shaped main body 5*a* and an ignition tip 6 welded thereon. The ignition tip 6 is made of platinum metal or a platinum metal base alloy, for example a rhodium base alloy or iridium base alloy. The main body 5*a* can be manufactured from steel or a nickel base alloy, for example from Inconel. The service life of an ignition needle can thus be considerably extended even with a small quantity of platinum metal. The welding on of an ignition tip 6 made of platinum metal leads here to improved results compared to the plating of a main body with noble metal, since a plated-on protective layer is damaged by burn-up after a relatively short period of time to an extent that the main body is no longer protected. By contrast, an ignition tip consisting solidly of platinum metal or a platinum metal base alloy can withstand burn-up for a much longer period of time. The ignition tip preferably consists at least 90% by weight of platinum metal, for example at least 95% by weight of platinum metal.

For example, a wire can be welded onto a pin-shaped main body 5*a* as an ignition tip 6. In the shown embodiment, an ignition tip 6 is a welded-on piece of wire, wherein the longitudinal direction of the wire runs in the longitudinal direction of the main body. The wire preferably has a smaller diameter than the main body. Instead of a wire portion, differently shaped parts can also be welded on as ignition tips, for example cubes, spheres or hemispheres.

The shape of the ignition tip can be formed with or without welded-on noble metal element by form grinding. For this purpose, the tip can be reground conically with a tangential transition to the cylindrical needle shaft. For improved heat dissipation from the ignition tip, it is advantageous not to grind a purely spherical shape, but rather to select an elliptical shape in the contour.

Even in the case of an ignition needle 5 having a welded-on ignition tip 6, an ignition edge running at an incline relative to the longitudinal direction of the ignition needle 5 is advantageous. For example, the ignition needle 5 shown in FIG. 5 can be ground or cut along a plane running transverse to the longitudinal direction of the ignition needle, and the ignition tip 6 may thus be provided with an ignition edge that has an elliptical course.

While exemplary embodiments have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A corona ignition device for igniting fuel in a combustion chamber of an engine by means of a corona discharge, comprising:

an insulator;

a center electrode, which is surrounded by the insulator and carries an ignition head having a plurality of ignition needles; and a housing, which holds the insulator;

wherein the ignition needles and the center electrode are plugged into holes formed in the ignition head.

2. The corona ignition device according to claim 1, wherein the ignition head is integrally bonded to the ignition needles.

3. The corona ignition device according to claim 1, wherein the ignition needles comprise a pin-shaped main body and an ignition tip welded onto the main body.

4. The corona ignition device according to claim 1, wherein the ignition tips consist of platinum metal or an alloy based on platinum metal.

5. The corona ignition device according to claim 3, wherein the ignition tips are made of wire.

6. The corona ignition device according to claim 5, wherein the ignition needles have an ignition edge running at an incline relative to the longitudinal direction of the ignition needles.

7. The corona ignition device according to claim 6, wherein the ignition edge has an elliptical course.

8. A method for producing an ignition head for a corona ignition device, comprising:

providing a center electrode;

providing ignition needles;

producing a green compact of an ignition head by injection molding of metal powder;

plugging the ignition needles into the green compact; and sintering the green compact, thereby producing an ignition head with the ignition needles fastened thereto.

9. The method according to claim 8, wherein, before the injection molding, the ignition needles are placed in an injection mold and are then overmolded as the green compact is powder injection molded, and a green compact having ignition needles stuck therein is thus produced.

10. The method according to claim 8, wherein the ignition needles are each provided with an ignition edge by grinding or cutting along a plane running at an incline relative to the longitudinal direction of the ignition needles.

11. The method of claim 8, further comprising plugging the center electrode into the green compact.

* * * * *